US011193353B2

(12) United States Patent
Vick, Jr. et al.

(10) Patent No.: US 11,193,353 B2
(45) Date of Patent: Dec. 7, 2021

(54) SLIDING SLEEVE WELL TOOL WITH METAL-TO-METAL SEAL

(71) Applicant: Halliburton Energy Services, Inc., Houston, TX (US)

(72) Inventors: James Dan Vick, Jr., Dallas, TX (US); Jimmie Robert Williamson, Jr., Denton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 693 days.

(21) Appl. No.: 14/430,668

(22) PCT Filed: Oct. 4, 2012

(86) PCT No.: PCT/US2012/058635
§ 371 (c)(1),
(2) Date: Mar. 24, 2015

(87) PCT Pub. No.: WO2014/055077
PCT Pub. Date: Apr. 10, 2014

(65) Prior Publication Data

US 2015/0308228 A1 Oct. 29, 2015

(51) Int. Cl.
*E21B 34/12* (2006.01)
*E21B 43/12* (2006.01)

(52) U.S. Cl.
CPC ..... *E21B 34/12* (2013.01); *E21B 43/12* (2013.01); *E21B 2200/06* (2020.05)

(58) Field of Classification Search
CPC ..... E21B 34/12; E21B 43/12; E21B 34/10; E21B 2034/007; E21B 2033/005
See application file for complete search history.

(56) References Cited

U.S. PATENT DOCUMENTS

| | | | | |
|---|---|---|---|---|
| 4,116,451 | A | 9/1978 | Nixon et al. | |
| 4,131,287 | A | 12/1978 | Gunderson et al. | |
| 4,178,020 | A | 12/1979 | Dopyera | |
| 4,411,317 | A | 10/1983 | Gieswein | |
| 4,448,427 | A * | 5/1984 | Mashaw, Jr. | E21B 34/14 166/118 |
| 4,595,053 | A | 6/1986 | Watkins et al. | |
| RE32,390 | E * | 4/1987 | Pringle | E21B 34/10 166/321 |

(Continued)

FOREIGN PATENT DOCUMENTS

WO WO99-53170 10/1999

OTHER PUBLICATIONS

The Lee Company, "Lee Plug", http://www.theleeco.com/PLUGWEB2.NSF/Plugs!OpenView, Mar. 28, 2012, 5 pages.

(Continued)

*Primary Examiner* — Waseem Moorad
*Assistant Examiner* — Neel Girish Patel
(74) *Attorney, Agent, or Firm* — Scott Richardson; Parker Justiss, P.C.

(57) ABSTRACT

A sliding sleeve well device has a first sliding sleeve received in a second sliding sleeve. A polymer seal having a polymer sealing surface is between and in sealing contact with the sliding sleeves. A metal-to-metal seal is between the sliding sleeves and actuable into sealing contact with the first and second sliding sleeves.

20 Claims, 5 Drawing Sheets

(56) References Cited

U.S. PATENT DOCUMENTS 4,751,965 A 6/1988 Cassity
4,761,023 A 8/1988 Troxell, Jr.
4,771,832 A 9/1988 Bridges
4,932,474 A * 6/1990 Schroeder, Jr. ..... E21B 43/045 166/278
5,044,672 A 9/1991 Skeels et al.
5,098,132 A 3/1992 Burton
5,193,616 A * 3/1993 Hynes ..... E21B 33/04 166/208
5,584,488 A * 12/1996 Lembcke ..... E21B 17/06 277/314
6,510,895 B1 1/2003 Koleilat et al.
6,666,276 B1 * 12/2003 Yokley ..... E21B 23/01 166/118
7,445,047 B2 * 11/2008 Gomez ..... E21B 34/14 166/334.4
7,866,402 B2 * 1/2011 Williamson, Jr. .... E21B 21/103 166/319
9,828,828 B2 * 11/2017 Doane ..... E21B 33/1285
2003/0056951 A1 * 3/2003 Kaszuba ..... E21B 34/101 166/250.01
2004/0055758 A1 * 3/2004 Brezinski ..... E21B 33/12 166/384
2006/0186601 A1 * 8/2006 Lopez ..... E21B 33/12 277/327
2007/0096465 A1 * 5/2007 Hall ..... E21B 17/02 285/342
2008/0061510 A1 * 3/2008 Li ..... E21B 33/00 166/382
2008/0093079 A1 * 4/2008 Bryant ..... E21B 33/03 166/313
2009/0152817 A1 * 6/2009 Du ..... F16L 7/02 277/315
2010/0089587 A1 * 4/2010 Stout ..... E21B 23/04 166/319
2010/0147533 A1 * 6/2010 Nelson ..... E21B 33/04 166/379
2010/0163253 A1 7/2010 Caldwell et al.
2011/0180275 A1 * 7/2011 Shaw ..... E21B 33/04 166/387
2011/0204273 A1 * 8/2011 Braekke ..... E21B 34/14 251/314
2012/0098203 A1 * 4/2012 Duong ..... E21B 33/03 277/322
2012/0241175 A1 * 9/2012 Galle ..... E21B 33/03 166/387
2014/0090894 A1 * 4/2014 Wolf ..... E21B 41/0042 175/61

OTHER PUBLICATIONS

Halliburton, "Subsurface Flow Controls", Copyright 2009, 29 pages.
Halliburton, "Circulating Valve", Completion Tools, May 2012, 2 pages.
The Lee Co., "Ø .656" Stainless Steel Plugs for 3000 psi Systems", http://www.theleeco.com/PLUGWEB2.NSF/d56166959694023e852563a9005dafda/54fda, Aug. 28, 2012, 1 page.
Caledyne, "MTM Sliding Sleeve Valve", Copyright 2011, 1 page.
Caledyne, "Metal to Metal Seal System", Copyright 2011, 1 page.
FMC Technologies, "Metal-to-Metal Seals", Surface Wellhead Sealing Technology, Copyright 2007, 8 pages.
PCT International Search Report and Written Opinion of the International Searching Authority, PCT/US2012/058635, dated Apr. 8, 2013, 11 pages.
PCT International Preliminary Report on Patentability, PCT/US2012/058635, dated Apr. 16, 2015, 8 pages.

* cited by examiner

SLIDING SLEEVE WELL TOOL WITH METAL-TO-METAL SEAL

CROSS-REFERENCE TO RELATED APPLICATIONS

This application is a 371 U.S. National Phase Application of and claims the benefit of priority to International Application Serial No. PCT/US2012/058635, filed on Oct. 4, 2012 and entitled "Sliding Sleeve Well Tool with Metal-to-Metal Seal", the contents of which are hereby incorporated by reference.

BACKGROUND

Downhole conditions in a well present numerous sealing challenges. For example, components of many well tools must be able to move relative to one another and then be sealed. Polymer seals, like O-rings, chevron seals, and other polymer seals, are typically used in such applications, because they do not damage adjacent metallic sealing surfaces when passed over the surfaces. Additionally, polymer seals can provide effective sealing, and can be reinforced or provided with back-up rings to seal against high pressure differentials. However, when subjected to prolonged high temperature, the polymer of the seals tends to break down and may eventually leak. Metal-to-metal seals can withstand high pressure and high temperature for extended periods of time without breaking down. However, metal-to-metal seals that form gas tight seals do so with an interference fit against their mating surfaces. Therefore, are not suitable for sealing between components that must move relative to one another, because the interference fit will mar the mating surfaces or damage the seal surface if moved.

DESCRIPTION OF DRAWINGS

Like reference symbols in the various drawings indicate like elements.

DETAILED DESCRIPTION

Figure 1:
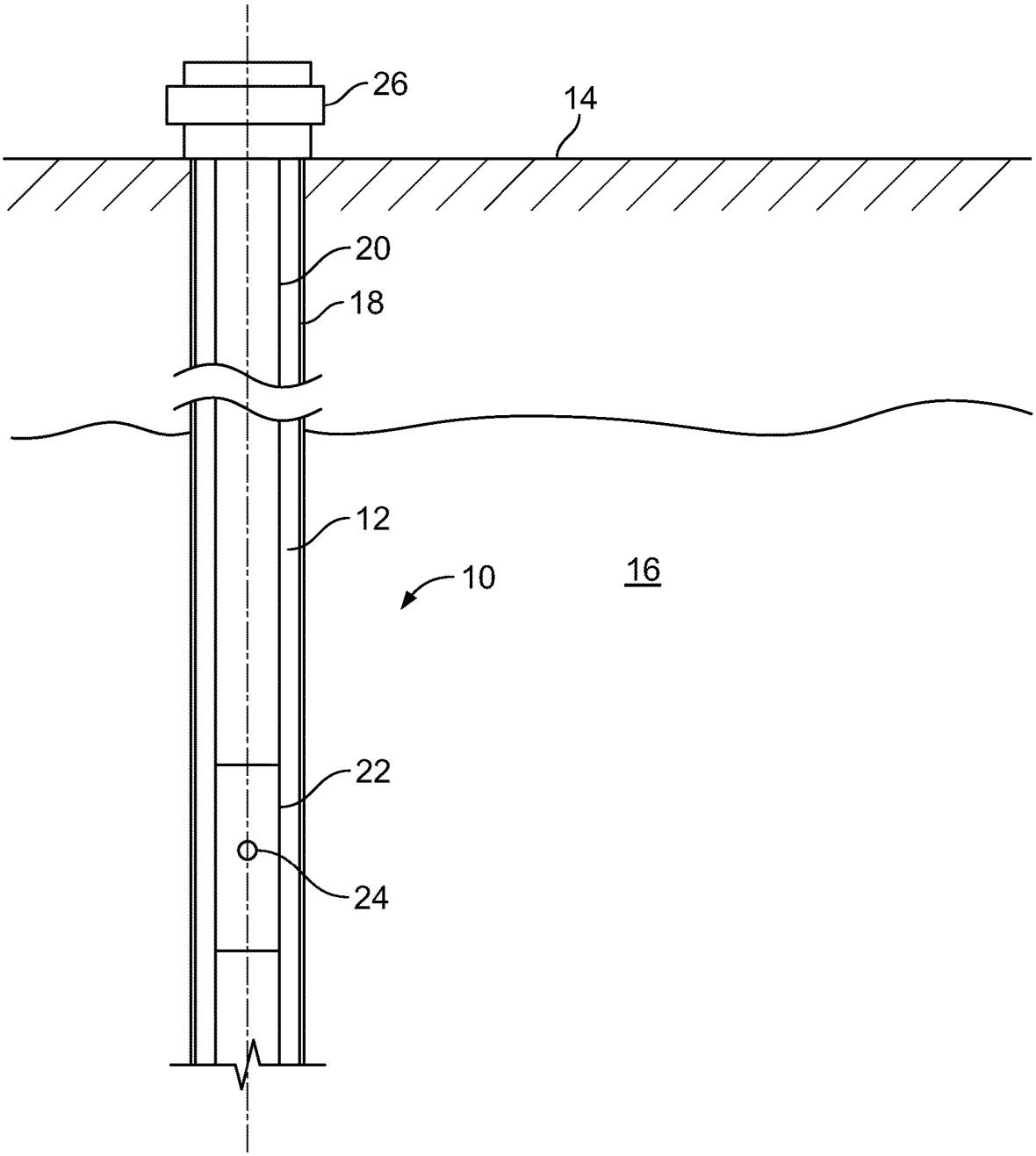
FIG. 1 is a side cross-sectional view of an example well system having an example sliding sleeve well tool.

Referring first to FIG. 1, a well 10 includes a substantially cylindrical wellbore 12 that extends from a wellhead 26 at the surface 14 downward into the Earth into one or more subterranean zones of interest 16 (one shown). The subterranean zone 16 can corresponding to a single formation, a portion of a formation, or more than one formulation accessed by the well 10, and a given well 10 can access one or more than one subterranean zone 16. In certain instances, the formations of the subterranean zone are hydrocarbon bearing, such as oil and/or gas deposits, and the well 10 will be used to produce the hydrocarbons and/or used in aiding production of the hydrocarbons from another well. A portion of the wellbore 12 extending from the wellhead 26 to the subterranean zone 16 is lined with lengths of tubing, called casing 18.

The depicted well 10 is a vertical well, extending substantially vertically from the surface 14 to the subterranean zone 16. The concepts herein, however, are applicable to many other different configurations of wells, including horizontal, slanted or otherwise deviated wells, and multilateral wells.

A completion string 20 is shown as having been lowered from the surface 14 into the wellbore 12. The completion string 20 can be a series of jointed tubings coupled together and/or a continuous (i.e., not jointed) coiled tubing, and can include one or more well tools (e.g., one shown, well tool 22). The string 20 has an interior, center bore that enables communication of fluid between the wellhead 26 and locations downhole (e.g., the subterranean zone 16 and/or other locations). In still other instances, the string 20 can be arranged such that it does not extend from the surface 14, but rather depends into the well on a wire, such as a slickline, wireline, e-line and/or other wire.

The well tool 22 is of a type having inner and outer sliding sleeves or tubings that move relative to one another. In certain instances, the tubings can be manipulated mechanically, for example, using a shifting tool run on tubing or wire to grip and move the inner tubing. The well tool 22 has sealing arrangement that allows the tubings to move relative to one another while maintaining a seal between the tubings, and that can additionally be actuated to form a metal-to-metal seal between the tubings. In certain instances, the sealing arrangement can include seals that cooperate with the metal-to-metal seal to provide redundant (the metal-to-metal seals plus an additional set of seals) or double redundant (the metal-to-metal seals, plus two additional sets of seals) sealing. For example, additional polymer seals having polymer sealing surfaces can be provided that seal between the tubings before and after actuation of the metal-to-metal seal. In certain instances the seal formed by the seals can be gas tight. In certain instances, the seal formed by the seals can be a VO seal under International Organization for Standardization (ISO) 14310. By using both polymer seals and metal-to-metal seals, the well tool 22 can benefit from the high quality seal formed by polymer seals and the robustness to temperature and high pressure of metal-to-metal seals. In certain instances, the tool 22 can be rated to operate in pressures of 15,000 psi (103 MPa) and 450° F. (232° C.).

In FIG. 1, the well tool 22 is shown in the context of a circulation tool having a sidewall port 24 that can be opened and closed to allow communication between the center bore and the exterior of the well tool 22 (e.g., the annulus between the well tool 22 and the wall of the wellbore 12). A circulation tool would typically (although not necessarily) be placed near and above the production packer (not shown) to enable circulation of fluids down the center bore and up the annulus or vice versa, for example, to flush and replace drilling mud with completion fluid in preparing a well for kickoff. Therefore, although the concepts herein are described with respect to a circulation tool, they are applicable to other types of well tools, as well.

Figure 2A:
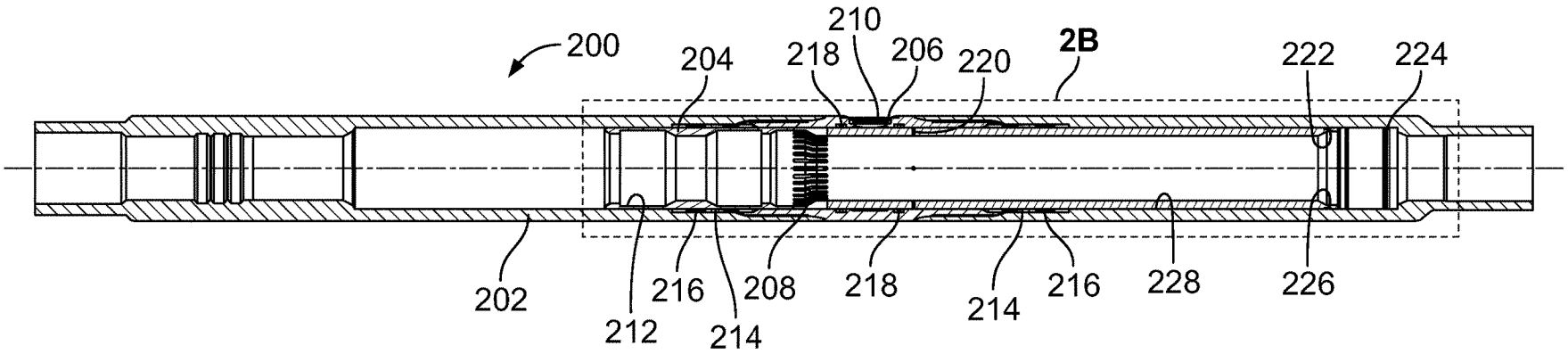
FIG. 2A is a side cross-sectional view of an example sliding sleeve well tool in a temporary closed state.

FIG. 2A shows an example well tool 200 that can be used as well tool 22. The well tool 200 is a sliding sleeve circulation tool that includes an inner tubing 204 received in an outer tubing 202 to move axially with respect to the outer tubing 202. The outer tubing 202 has a side port 206 that communicates between an interior, center bore of the outer tubing 202 (i.e., the bore receiving the inner tubing 204) and the exterior of the well tool 200. The side port 206 is shown closed over and sealed with a rupture disk 210. However, in other instances, the rupture disk 210 can be omitted. The inner tubing 204, likewise, has a side port 208, shown in FIG. 2A as a series of axial slots arrayed around the circumference of the tubing 204. The side ports 208 of the inner tubing 204 communicate between an interior, center bore of the inner tubing 204 and the exterior of the inner tubing 204. The inner tubing 204 additionally includes one or more holes 220 axially spaced from the port 208. Like the port 208, the holes 220 communicate between the interior, center bore of the inner tubing 204 and the exterior of the inner tubing 204.

The interior, center bore of the inner tubing 204 includes a bidirectional tool profile 212 configured to be gripped by collets and/or dogs of a shifting tool run in through the center bore. The profile 212 allows the inner tubing 204 to be axially moved in relation to the outer tubing 202.

Figure 2B:
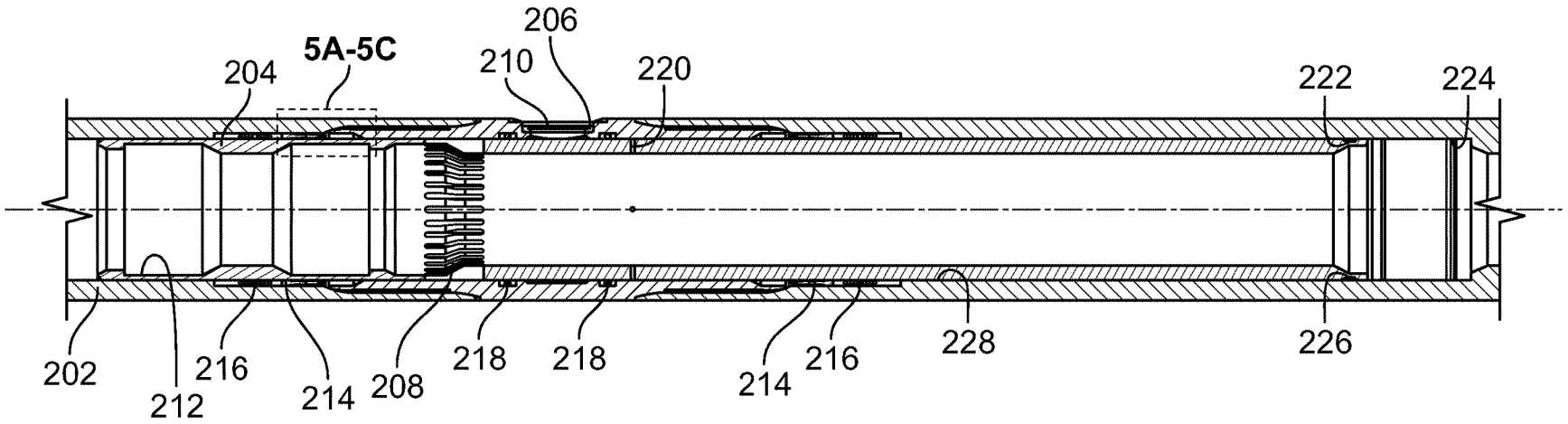
FIG. 2B is a detail side cross-sectional view of the example sliding sleeve well tool of FIG. 2A.

As is better seen in FIG. 2B, the outer tubing 202 carries two elastomer O-ring seals 218 on opposing axial sides of the side port 206 (i.e., axially bracketing the side port 206). The seals 218 are between and in sealing contact with the outer tubing 202 and the inner tubing 204 and seal the fluid path between the tubings. As O-rings, the O-ring seals 218 have polymer sealing surfaces. The O-ring seals 218 can include back-up/anti-extrusion rings and/or other elements. In certain instances, the O-ring seals 218 are arranged to provide bidirectional sealing. In certain instances, the outer tubing 202 can be segmented, formed of multiple sections of tubing coupled together (threadingly and/or otherwise) to facilitate access for installation and servicing the O-ring and seals carried by the tubing 202. Notably, although described as O-ring seals, the seals 218 could be provided in other configurations.

The outer tubing 202 carries two sets of annular, metal-to-metal seals 214 positioned on opposing axial sides of the side port 206 axially bracketing the side port 206 and O-ring seals 218. In an unactauted state, the metal-to-metal seals 214 lightly contact or reside out of contact with adjacent surfaces of the outer tubing 202 and/or the inner tubing 204, such that when the tubings 202, 204 move axially relative to one another, the metal sealing surfaces of the metal-to-metal seals 214 do not mar or otherwise damage (substantially or at all) these surfaces in manner that would prevent later sealing against both surfaces with the metal-to-metal seal 214 and/or certain other types of seals (e.g., O-ring seals 218 and/or polymer seals 216, discussed below). The metal-to-metal seals 214 can be actuated from the unactauted state to an actuated, sealed state where the metal-to-metal seals 214 sealingly contact the outer tubing 202 and inner tubing 204 and form an interference, metal-to-metal seal sealing the fluid path between the outer tubing 202 and the inner tubing 204. In certain instances, the metal-to-metal seal formed by the seal 214 is gas tight. In certain instances, the metal-to-metal seal formed by the seal 214 is a V0 seal. Additionally, in certain instances, when actuated to the sealed state, the metal-to-metal seal 214 axially affixes the outer tubing 202 to the inner tubing 204 by gripping the two tubings. Moving the tubings 202, 204 relative to one another while in this affixed state would damage or destroy the metal-to-metal seals 214 and/or the surfaces of the tubings 202, 204 contacted by the metal-to-metal seals 214. In certain instances, the metal-to-metal seals 214 can be actuated from the unactauted to the actuated, sealed state by axially compressing the seals. Some examples of seals that can be used as metal-to-metal seal 214 are described in more detail below in connection with FIGS. 5A-C.

Figure 5A:
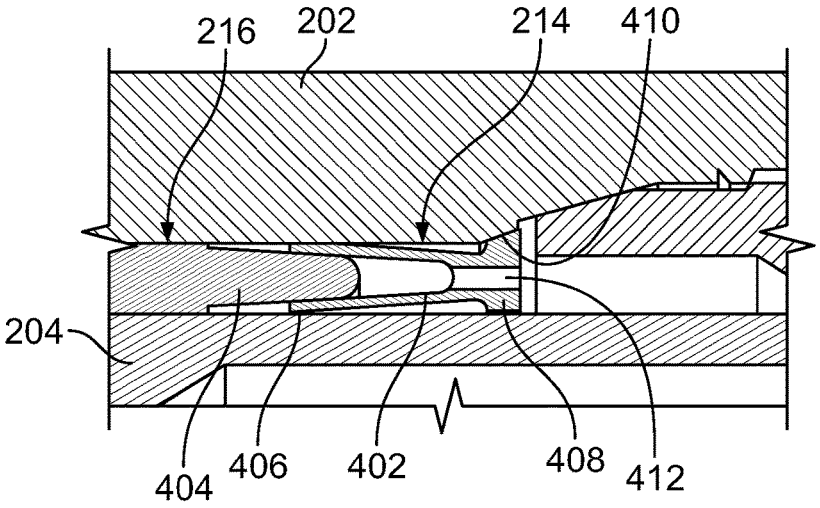
FIG. 5A-5C are detail side cross-sectional views showing three examples of metal-to-metal seals.

FIG. 5A depicts an example annular metal-to-metal seal 214 having a seal ring 402 that is generally U-shaped in cross-section, having an annular heel section 408 and two axially protruding annular lip sections 406. The lip sections 460 define a generally wedge shape with two opposing metal exterior seal surfaces on the inner diameter and outer diameter of the annular seal 214. The annular lip sections 406 internally receive an annular wedge 404, with a locking taper, that when axially driven into the interior of the lip sections 406, radially spreads the lip sections into interference, metal-to-metal sealing contact with the inner diameter of the outer tubing 202 and the outer diameter of the inner tubing 204. In certain instances, the locking taper angle is less than 3.5°. The heel section 408 includes a plurality of vent holes 412 that prevent trapping fluid between the wedge 404 and the interior of the lip sections 406. Additionally, the heel section 408 has an exterior profile configured to match and engage a corresponding profile 410 of the tubings 202, 204 to aid in axially positioning the seal 214 with respect to the tubings 202, 204.

Figure 5B:
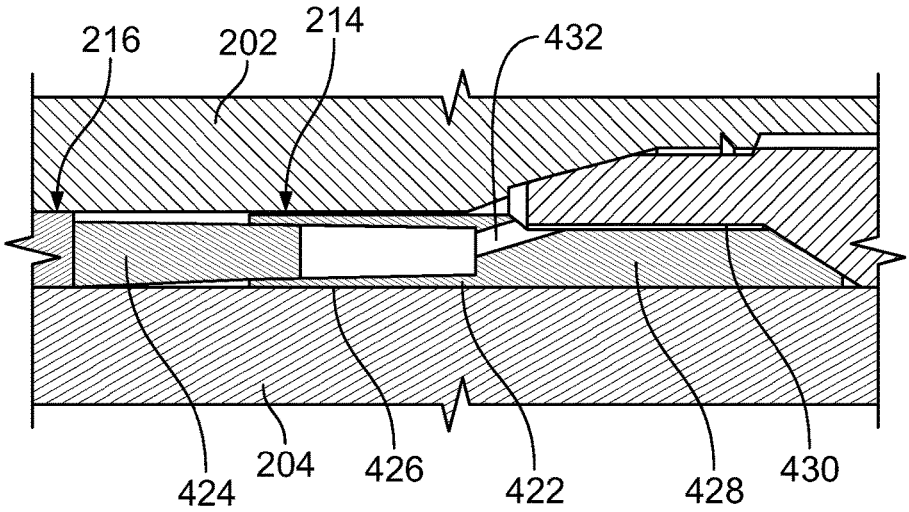

FIG. 5B depicts another example annular metal-to-metal seal 214 also having a seal ring 402 that is generally U-shaped in cross-section. However, in FIG. 5B, the seal 214 is configured as a labyrinth type seal. Thus, as above, the seal 214 has an annular heel section 428 and two axially protruding angular lip sections 406. As a labyrinth type seal, however, the lip sections 406 generally parallel the inner diameter of the outer tubing 202 and the outer diameter of the inner tubing 204, and have two opposing, annularly toothed metal exterior seal surfaces on the inner diameter and outer diameter of annular seal 214. The teeth are not helical and do not otherwise define an axial path. When the annular wedge 424, with a locking taper, is axially driven into the interior of the lip sections 426, the lip sections 426 radially spread, and the toothed metal exterior seal surfaces move into sealing contact, forming an interference metal-to-metal seal with the interior diameter of the outer tubing 202 and the outer diameter of the inner tuning 202. As above, in certain instances the heel section 428 includes a plurality of vent holes 432 that prevent trapping fluid between the wedge 424 and the interior of the lip sections 426. Additionally, as above, in certain instances the heel section has an exterior profile configured to match and engage a corresponding profile 430 of the tubings 202, 204 to help axially positioned seal 214 with respect to the tubings 202, 204.

Figure 5C:
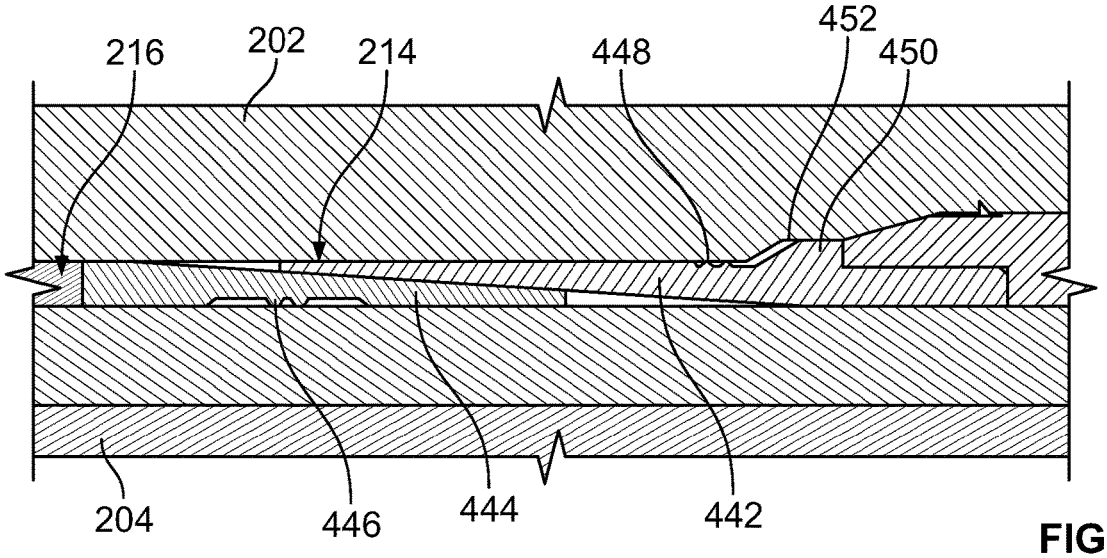

FIG. 5C depicts yet another example annular metal-to-metal seal 214 configured as two opposing, annular wedges 442, 444. Each of the wedges 442, 444 define opposing metal exterior seal surfaces on the inner diameter and outer diameter of the annular seal 214. When the annular wedges 442, 444 are axially driven into one another, the wedges 442, 444 spread radially into sealing contact with the inner diameter of the outer tubing 202 and the outer diameter of the inner tubing 204, forming an interference, metal-to-metal seal. In certain instances, one or both of the exterior seal surfaces can include annular ridges 446, 448 designed to bite into interference with the surfaces of the tubings 202, 204. In certain instances, one of the wedges can include an annular lug 450 configured to match and engage a corresponding profile 452 of the tubings 202, 204 to help axially positioning the seal 214 with respect to the tubings 202, 204.

Referring back to FIG. 2B, the outer tubing 202 additionally carries two sets of annular, polymer seals 216 adjacent, and in certain instances, abutting the metal-to-metal seals. In certain instances, the polymer seals 216 are non-elastic seals. Like the metal-to-metal seals 214, the polymer seals 216 are positioned on opposing axial sides of the side port 206 axially bracketing the side port 206, the O-ring seals 218 and the metal-to-metal seals 214. The polymer seals 216 may or may not be entirely polymer but have polymer sealing surfaces on their inner and outer diameter. In certain instances, the polymer seals 216 are multi-element chevron non-elastomer seal sets having a plurality of stacked, annular seal rings. The seals 216 are between and in sealing contact with the outer tubing 202 and the inner tubing 204 and seal the fluid path between the tubings. In certain instances, the polymer seals 216 are arranged to provide bidirectional sealing. In certain instances, the polymer seals 216 form a gas tight seal.

The polymer seals 216 are configured to move axially in their seal grooves relative to the tubings 202, 204 to actuate the metal-to-metal seal 214. For example, in configurations having an annular wedge (e.g., annular wedge 404 or annular wedge 424), pressure acting on the polymer seals 216 can drive the seals 216 axially into the annular wedge to, in turn, drive the annular wedge into the generally U-shaped seal ring and actuate the seal 214. For example, in configurations having opposing annular wedges (e.g. annular wedges 442, 444), pressure acting on the polymer seals 216 can drive the seals 216 axially into one annular wedge, driving it into the other annular wedge in actuating the seal 214.

FIGS. 2A and 2B show the well tool 200 in a first, temporary closed state where the volume exterior the tool 200 is sealed from the interior, center bore of the tubings 202, 204, in part, because the side port 206 in the outer tubing 202 is sealed from communication with the interior, center bore of the inner tubing 204. Fluidically speaking, the well tool 200 in the temporary closed state operates as a solid piece of tubing. Specifically, the side port 206 is sealed from the side port 208 in the inner tubing 204, the holes 220 in the inner tubing 204 and any fluid in between the tubings 202, 204 by O-ring seals 218. Further, radial expansion of the inner tubing 204 in response to pressure in its center bore tends to reduce the gap between the tubings 202, 204 sealed by the O-rings 218, and thus aids against extrusion of the O-rings 218 under high pressure. Notably, in this temporary closed state, the metal-to-metal seal 214 has not been actuated, because there is no pressure differential across the metal-to-metal seals 214 and polymer seals 216. There is no pressure differential, because holes 220 and the fluid path between the tubings 202, 204 communicate the same pressure to opposing sides the seals 214, 216 at the right of the figure, and side port 208 and the fluid path between the tubings 202, 204 communicate the same pressure to opposing sides of the seals 214, 216 at the left of the figure. Also, in the temporary closed state, the O-ring seals 218, polymer seals 216 and metal-to-metal seals 214 are shielded from flow through the interior, center bore of the tubing 204. The tubing 204 includes a profile 222 on its exterior that has an interference fit with, and thus grippingly engages a corresponding profile 226 and the outer tubing 202 to help maintain the well tool 200 in the first, temporary closed state.

Figure 3A:
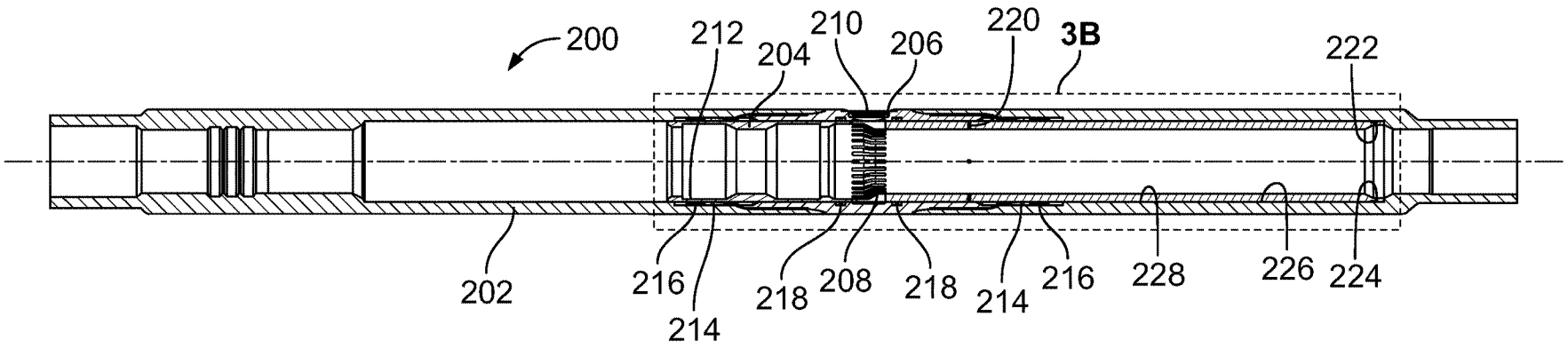
FIG. 3A is a side cross-sectional view of the example sliding sleeve well tool in an open state.
Figure 3B:
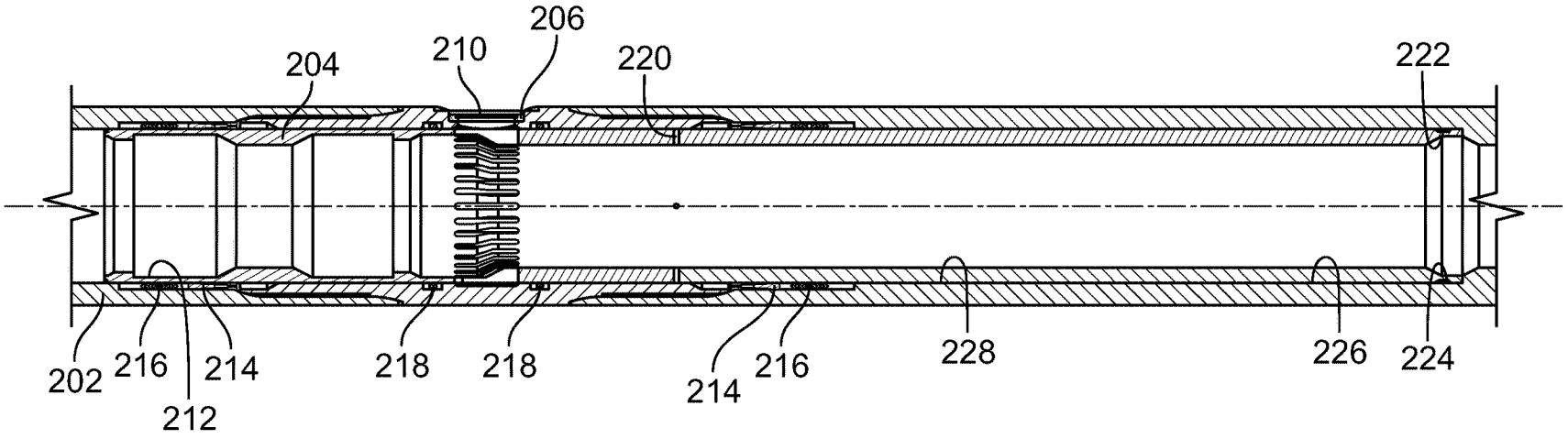
FIG. 3B is a detail side cross-sectional view of the example sliding sleeve well tool of FIG. 3A.

FIGS. 3A and 3B show the well tool in an open state, where the volume exterior the tool 200 is allowed to communicate with the interior, center bore of the inner tubing 204, provided that the rupture disk 210 (if provided) has been ruptured. Specifically, the side port 208 in the inner tubing 204 is aligned to fluidically communicate with the side port 206 in the outer tubing 202. Further, the O-ring seals 218 axially bracket the aligned ports 206, 208 so that flow between the interior, center bore of the inner tubing 204 and the volume exterior the well tool 200 is confined to communicate through the ports 206, 208. Also, in the open state, the O-ring seals 218, polymer seals 216 and metal-to-metal seals 214 are shielded from flow through the interior, center bore of the tubing 204. If the rupture disk 210 is intact, the well tool 200 operates, fluidically speaking, as a solid piece of tubing until a pressure differential between the interior, center bore of the inner tubing 204 and the volume exterior the tool 200 reaches the specified burst pressure of the rupture disk 210. The profile 222 on the inner tubing 204 has an interference fit with, and thus grippingly engages another corresponding profile 226 on the inner diameter of the outer tubing 202 to help maintain the well tool 200 and the open state.

Figure 4A:
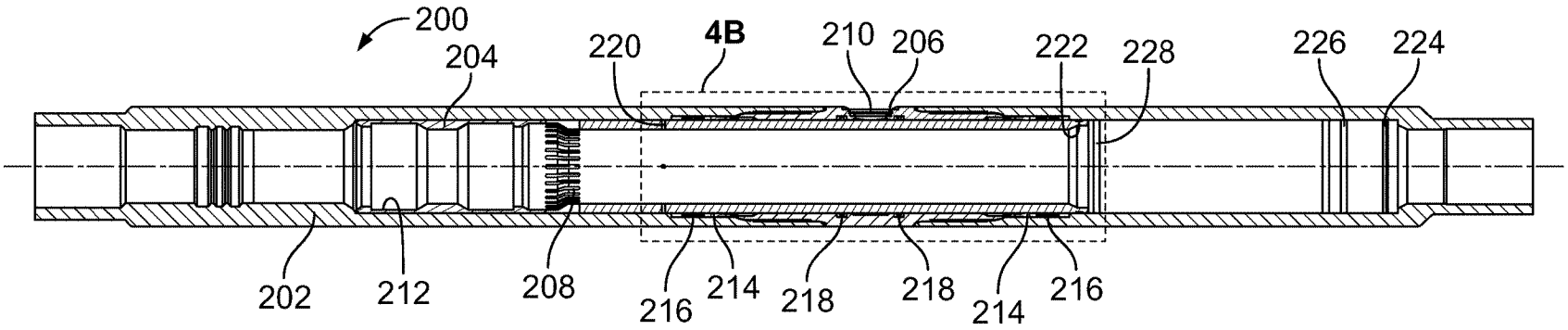
FIG. 4A is a side cross-sectional view of the example sliding sleeve well tool in a permanently closed state.
Figure 4B:
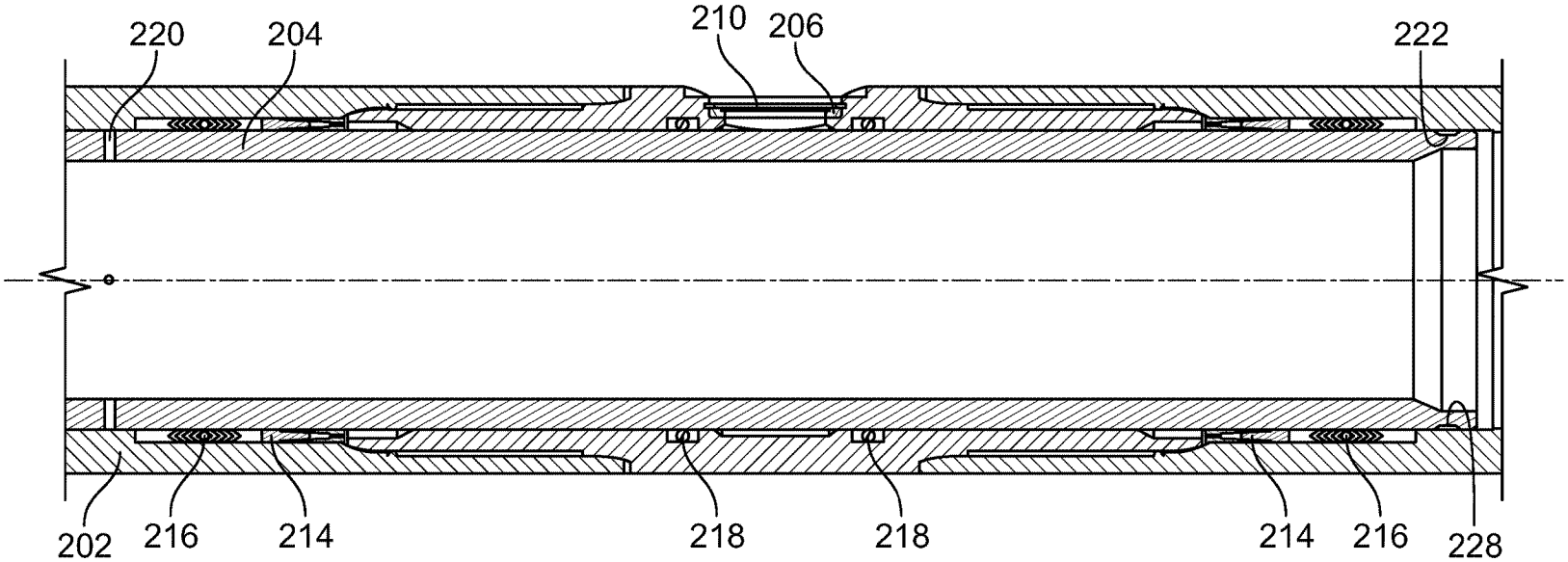
FIG. 4B is a detail side cross-sectional view of the example sliding sleeve well tool of FIG. 4A.

FIGS. 4A and 4B show the well tool 200 in a second, closed state that, when the metal-to-metal seals 214 have been actuated, can be a permanently closed state. In the second, closed state volume exterior the tool 200 is sealed from the interior, center bore of the inner tubings 202, 204. Fluidically speaking, the well tool 200 in the second, closed state operates as a solid piece of tubing. Specifically, the side port 206 is sealed from the side port 208 in the inner tubing 204, the holes 220 in the inner tubing 204 and any fluid in between the tubings 202, 204 by O-ring seals 218, polymer seals 216, and if actuated, the metal-to-metal seals 214. Thus in the second, closed state, the volume exterior the tool 200 is sealed from the interior center bore of the inner tubings 202, 204 by redundant, polymer seals—initially the O-ring seals 218, and if the O-ring seals 218 leak, then the polymer seals 216. If a substantial pressure differential develops across the polymer seals 216, for example if the internal pressure is greater than the external pressure and the O-ring seals 218 leak, the polymer seals 216 will move axially towards the metal-to-metal seal 214, axially compress the metal-to-metal seals 214, and actuate the metal-to-metal seals 214 into sealing engagement with the tubings 202, 204. Thus, if the metal-to-metal seals 214 are actuated, the volume exterior the tool 200 is sealed from the interior, center bore of the inner tubings 202, 204 by double redundant seals. Also, in the permanently closed state, the O-ring seals 218, polymer seals 216 and metal-to-metal seals 214 are shielded from flow through the interior, center bore of the tubing 204. The profile 222 on the inner tubing 204 has an interference fit with, and thus grippingly engages, yet another corresponding profile 228 on the inner diameter of the outer tubing 202 to help maintain the well tool 200 in the second, closed state, particularly prior to actuation of the metal-to-metal seals 214. After actuation of the metal-to-metal seals 214, the well tool 200 will be additionally maintained in the second, closed state by the metal-to-metal seals 214 grippingly engaging and relatively affixing the tubings 202, 204.

In operation, the well tool 200 is coupled into a string of additional tubing and/or other well tools. The ends of the well tool 200 are configured to couple (threadingly and/or otherwise) to other tubing and/or components of a tubing string. Although, typically, the end of the well tool 200 to the left of the figure will be the uphole end (when the tool 200 is received in a well), in certain instances, the orientation of the tool 200 could be reversed and the end of the tool 200 to the left of the figure could be the downhole end. In either instance, the well tool 200 is run into the well as part of the tubing string.

The well tool 200 can be run into the well in either the first, temporary closed position (FIG. 3A and 3B) or the open position (FIG. 2A and 2B). If the well tool 200 is in the open position, it can be provided with a rupture disc 210 to operate as a solid tubing, fluidically speaking, until subjected to a pressure differential across rupture disk 210 in excess of the specified burst pressure. In the first, temporary closed position or in the open position with a rupture disc 210, the string can be pressure tested.

Thereafter, if the well tool 200 was run into the well in the temporary closed position, the inner tubing 204 can be shifted open to allow communication of fluids between the interior, center bore of the tubings 202, 204 and the exterior of the well tool 200, for example, for circulation and changing of fluids in the well and/or for other purposes. The well tool 200 can be shifted open mechanically, with a shifting tool run on tubing or wire into the well and that the grippingly engages the profile 212. If the well tool 200 was run into the well in the open position with a rupture disk 210, the specified burst pressure of the ruptured this 210 can be exceeded to establish communication. Notably, with the tool 200 in the open and temporary closed state, the metal-to-metal seals 214 are not actuated, and thus, the metal-to-metal seals 214 do not mar or damage the sealing surfaces of the tubings 202, 204 when the inner tubing 204 is moved axially relative to the outer tubing 202. Therefore, the well tool 200 can be cycled between the open position and the temporary closed position multiple times, as needed, with a shifting tool.

Finally the well tool 200 can be permanently closed by shifting the inner tubing 204 to the second, closed position with a shifting tool run on tubing or wire into the well and that grippingly engages the profile 212. In the second, closed position, the well tool 200 seals communication of fluids between the interior, center bore of the tubings 202, 204 and the exterior of the well tool 200, for example, to hydraulically set the production packer, pressure test production tubing and/or for other purposes. If a pressure differential develops across the polymer seals 216, the polymer seals 216 will move axially towards the metal-to-metal seal 214, axially compressed the metal-to-metal seals 214, and actuate the metal-to-metal seals 214 into sealing engagement with the tubings 202, 204. Thereafter, the well tool 200 can remain in the well indefinitely, for the life of the well, and maintain its gas tight seal.

A number of implementations have been described. Nevertheless, it will be understood that various modifications may be made. Accordingly, other implementations are within the scope of the following claims.

What is claimed is:

1. A well tool, comprising:

an outer tubing having a seal groove formed in an interior wall thereof;

an inner tubing received in the outer tubing to move axially with respect to the outer tubing;

a first annular seal having only first and second metal components, wherein at least one of the first and second metal components is wedge-shaped having a locking taper angle less than 3.5° , the first and second metal components being engageable against each other and located in the seal groove and between the outer and inner tubings and actuable from an unsealed state to a, sealed state, wherein the first annular seal contacts and seals against the outer and inner tubings to form a metal-to-metal seal that seals a fluid path between the outer and inner tubings, and locks the inner and outer tubings together; and a second annular seal, wherein the second annular seal:

is located within the seal groove;

is located between and in sealing contact with the outer and inner tubings and sealing the fluid path;

is located on opposite axial sides of the first annular seal;

comprises a polymer seal having a sealing surface;

is movable with respect to the first annular seal within the seal groove; and drives one of the first or second metal components into the other and into a sealed, locked position.

2. The well tool of claim 1, wherein at least one of the first and second metal components include a toothed outer surface thereof that where in the sealed, locked position, the toothed surface is in contact with an interior surface of the outer tubing and an exterior surface of the inner tubing and, thereby affixing the inner tubing to the outer tubing.

3. The well tool of claim 1, where, when in the unsealed state, the first annular seal is slidable against surfaces of the outer and inner tubing during axial movement of the inner tubing relative to the outer tubing without substantially marring the surfaces.

4. The well tool of claim 1, where the first metal component of the first annular seal is a ring comprising a generally U-shaped cross-section and comprising a metallic exterior seal surface; and the second metal component of the first annular seal is a wedge in the interior of the U-shaped cross-section configured to move into the ring and radially expand the ring against an interior surface of the outer tubing and an interior surface of the inner tubing and into the sealed state and the locked position.

5. The well tool of claim 4, where the first annular seal is a labyrinth type seal comprising a toothed exterior seal surface.

6. The well tool of claim 1, where the first metal component is a first annular wedge oriented in a first axial direction; and the second metal component is a second annular wedge abutting the first axial wedge and oriented in an opposing axial direction.

7. The well tool of claim 1, where in the sealed state and locked position, the first annular seal forms a gas tight seal with the outer and inner tubing.

8. The well tool of claim 1, where the outer and inner tubings each comprise a side port; and where the first annular seal, in the sealed, locked position, seals a fluid path between the side port in the outer tubing and the side port in the inner tubing.

9. The well tool of claim 8, where the second annular seal seals the fluid path; and where fluid pressure acting on the second annular seal actuates the first annular seal to the sealed state and locked position.

10. The well tool of claim 9, further comprising a third annular seal between and in sealing contact with the outer and inner tubings, the third annular seal seals the fluid path extending between the first annular seal and the side port in the outer tubing.

11. The well tool of claim 8, where the well tool is changeable between:

an open position where the side ports in the outer and inner tubings allow communication of fluid between a center bore of the inner tubing and an exterior of the well tool;

a first closed state where the side port in the outer tubing is sealed from the side port in the inner tubing by the second annular seal between the first annular seal and the side ports; and a second closed state where the first annular seal is actuated to a sealed state and locked position, sealing the side port in the outer tubing from the side port in the inner tubing.

12. The well tool of claim 11, further comprising a rupture disk sealing the side port in the outer tubing.

13. The well tool of claim 1, where the well tool comprises a circulation tool.

14. A method, comprising:

axially moving a first tubing relative to a second tubing while the tubings are in a wellbore, the second tubing having a seal groove in an interior wall thereof and a polymer seal and a metal-to-metal seal located within the seal groove, the metal-to-metal seal having only first and second metal components engageable against each other, wherein at least one of the first and second metal components is wedge-shape and having a locking taper angle less than 3.5° ;

sealing a fluid path between the first and second tubings with the polymer seal having a sealing surface engaged against an interior wall of the second tubing; and increasing a fluid pressure within the first tubing to cause the polymer seal to move axially within the seal groove and engage one of the first and second metal components, thereby forcing the first and second metal components together to form a metal-to-metal seal between the first and second tubings, thereby sealing the fluid path between the first and second tubings and locking the first tubing to the second tubing, wherein the polymer seal is located on opposite axial sides of the metal-to-metal seal.

15. The method of claim 14, where axially moving the first tubing relative to the second tubing comprises:

moving the first tubing from an open position, where a side port of the first tubing communicates an interior of the first tubing with an exterior port of the second tubing, to a closed position where the metal-to-metal seal is axially between the side port of the first tubing and the exterior port of the second tubing; and where increasing a fluid pressure to form the metal-to-metal seal comprises actuating the metal-to-metal seal to seal against the first and second tubings to prevent fluid communication between the interior of the first tubing and the exterior port of the second tubing.

16. The method of claim 15, where axially moving the first tubing relative to the second tubing further comprises moving the first tubing from a second closed position, where the exterior port is sealed from the interior of the second tubing by the polymer seal, to an open position.

17. The method of claim 14, wherein the first metal component is a wedge and the second metal component is an annular seal ring having a generally U-shaped cross-section and where forming the metal-to-metal seal comprises using pressure in the interior of the first tubing to axially drive the polymer seal against the wedge and into an interior of the annular seal ring.

18. A sliding sleeve well device, comprising:

a first sliding sleeve received in a second sliding sleeve, the second sliding sleeve having a first seal groove located within an interior wall thereof;

a first polymer seal comprising a first polymer sealing surface between and in sealing contact with the sliding sleeves and located within the first seal groove; and a first metal-to-metal seal having only two metal components, wherein at least one of the metal components is wedge-shaped having a locking taper angle less than 3.5° and located within the first seal groove and between the first and second sliding sleeves, the first polymer seal being movable within the first seal groove to drive one of the metal components against another of the metal components and into a sealed state and a locked position, wherein the first and second sliding sleeves as locked together and the first polymer seal being located on opposite axial sides of the first metal-to-metal seal.

19. The well device of claim 18, further comprising:

an aperture through a sidewall of the second sleeve, the second sleeve having a second seal groove located in an interior wall thereof;

an aperture through a sidewall of the first sleeve;

a second polymer seal located within the second seal groove of the second sliding sleeve, comprising a second polymer sealing surface between and in sealing contact with the first and second sliding sleeves, the first and second polymer seals axially bracketing the aperture in the second sleeve;

a second metal-to-metal seal having second metal components, wherein at least one of the metal components is wedge-shaped having a locking taper angle less than 3.5° and being located within the second seal groove and between the first and second sliding sleeves, the first metal-to-metal seal and the second metal-to-metal seal axially bracketing the aperture in the second sleeve, the second polymer seal being movable within the second seal groove against one of the second metal components to drive the one of the second metal components against another of the second metal components and into a sealed state and a locked position, wherein the first and second sliding sleeved as locked together.

20. The well device of claim 19, where the first and second polymer seals are positioned adjacent the first and second metal-to-metal seals within the first and second seal grooves, respectively and operable to actuate the first and second metal-to-metal seals in response to pressure from interior the first sliding sleeve.

* * * * *